United States Patent [19]

Pekanmäki et al.

[11] Patent Number: 4,989,589

[45] Date of Patent: Feb. 5, 1991

[54] DEVICE FOR MASSAGING EXTERMITIES, SUCH AS LEGS

[76] Inventors: Kalle Pekanmäki, Pitkäkatu 12, 15150 Lahti 15; Lasse Andersson, Mestarinkatu 14, 15800 Lahti 80, both of Finland

[21] Appl. No.: 5,284

[22] Filed: Jan. 16, 1987

Related U.S. Application Data

[63] Continuation of Ser. No. 728,509, Apr. 29, 1985, abandoned.

[51] Int. Cl.[5] ..... A61H 9/00

[52] U.S. Cl. ..... 128/64; 128/24 R

[58] Field of Search ..... 128/24, 2, 24 A, 24 R, 128/25 B, 28, 32, 40, 45, 46, 47, 50–53, 56, 57, 59, 61, 62, 65, 66, 67, 64; 272/96; 15/28, 29

[56] References Cited

U.S. PATENT DOCUMENTS

| | | | |
|---|---|---|---|
| 2,781,041 | 2/1957 | Weinberg | 128/24 R |
| 3,412,730 | 11/1968 | MacLeod | 128/40 |
| 3,450,450 | 6/1969 | Hopkins | 128/38 |
| 3,548,809 | 12/1970 | Conti | 128/24 R |
| 3,712,298 | 1/1973 | Snowdon | 128/40 |
| 4,029,087 | 6/1977 | Dye | 128/24 R |
| 4,066,084 | 1/1978 | Tillander | 128/24 R |
| 4,206,751 | 6/1980 | Schneider | 128/24 R |
| 4,374,518 | 2/1983 | Villanueva | 128/64 |
| 4,448,189 | 5/1984 | Lasley | 128/25 R |
| 4,502,470 | 3/1985 | Kiser | 128/64 |

*Primary Examiner*—Edgar S. Burr
*Assistant Examiner*—Tonya Lamb

[57] ABSTRACT

A device for massaging extremities of the body, such as legs, and for activating fluid flows, said device consisting of consecutive, annular, mutually connected elastic jacket bags disposed to encircle the leg and in which pressures can be produced with the aid of a pressure source and a fluid, which cause a massaging effect. The drawback encumbering devices of this type known in prior art is that control of the pressure has been arranged by means of very complicated valve systems. The intervening space defined between the jacket bags of the present invention and the foot have also been connected to the pressure source and can therefore be pressurized, whereby the jacket bags are with the aid of the pressure in the intervening space simultaneously depletable of pressure and further, after the jacket bags have been pressurized, the intervening space is, with the aid of the pressure in the jacket bags, depletable of pressure.

9 Claims, 1 Drawing Sheet

DEVICE FOR MASSAGING EXTREMITIES, SUCH AS LEGS

This application is a continuation of application Ser. No. 728,509, filed Apr. 29, 1985, now abandoned.

BACKGROUND OF THE INVENTION

1. Field of the Invention

The present invention concerns a device for massaging extremities of the body, such as legs, and for activating fluid flows, said device consisting of consecutive annular elastic jacket bags disposed to encircle the leg and connected to each other, and in which pressures developing a massaging effect can be produced by the aid of a pressure source and a fluid.

2. Prior Art

A device of this type known in prior art has been disclosed for instance in the Finnish patent application No. 322/69. Such devices of prior art have the drawback that controlling the pressure with the aid of valves so that an upward massaging force is obtained on the legs is cumbersome and requires complicated valve means.

SUMMARY OF THE INVENTION

The object of the present invention is to eliminate the drawbacks addressed. The device of the invention is characterized in that the space between the jacket bags and the leg is also connected to the pressure source and can therefore be pressurized, whereby with the aid of the pressure in the intervening space the jacket bags can be simultaneously depleted of pressure and further, after the jacket bags have been pressurized, the intervening space can by the aid of the pressure in the jacket bags be depleted of pressure. With the aid of the invention, a bipartite jacket structure is obtained around the extremity, in which, alternatingly, an upward massaging force is produced with overpressure, or two pressure waves in the same direction. The device is simple to manufacture, and it can be made disposable as regards the jacket to be placed around the extremity. The pressure source, such as an air pump and the requisite control valve, may be constructed as a separate unit.

An advantageous embodiment of the invention is characterized in that the pressures in the jacket bags and in the intervening space are controlled by a multiple-way valve by which the pressure is conducted alternatingly into the jacket bags and into the intervening space. Therefore, in the device, an automatic pacing is produced which may be adjustable for instance by means of a throttling valve.

Another advantageous embodiment of the invention is characterized in that the fluid is air, cooled or heated as needed. In this way, ventilation air is introduced against the skin, either heated or cooled as needed. Such ventilation enables prolonged use of the device. In addition, for the gas introduced against the skin may be used oxygen, and this enables the device to be used also in medical therapy, for instance in treating lower leg lesions.

An advantageous embodiment of the invention is moreover characterized in that the pressure source is a pad-like pump under the leg, operating when the person walks. Thus, the entire device can be made to constitute a shoe, in which case it may be applied on all those who have disorders either in the venous system or in the lymphatic circulation of their lower extremity. The device is thus automatically operating and no separate external pressure source is needed.

BRIEF DESCRIPTION OF THE DRAWINGS

The invention is described in the following by the aid of an example referring to the drawing attached, wherein.

Figure 1:
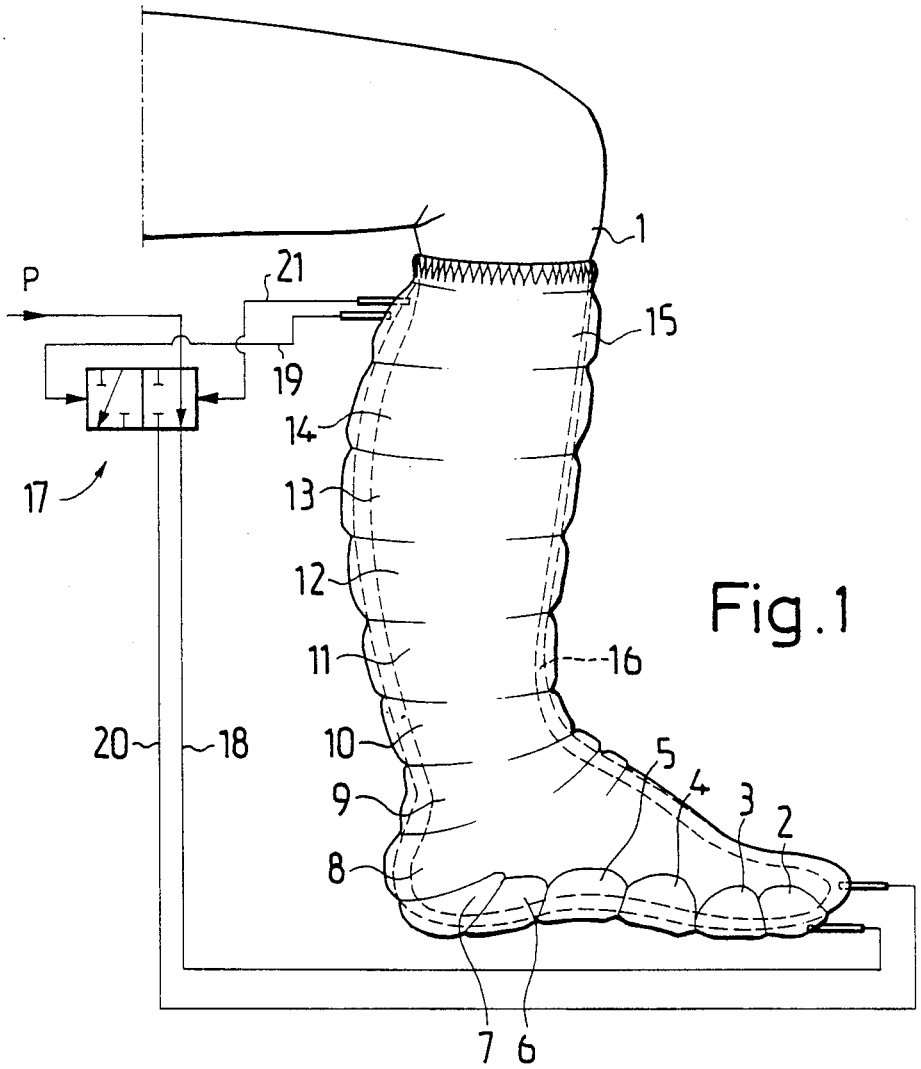
FIG. 1 presents the device, applied on the leg.
Figure 2:
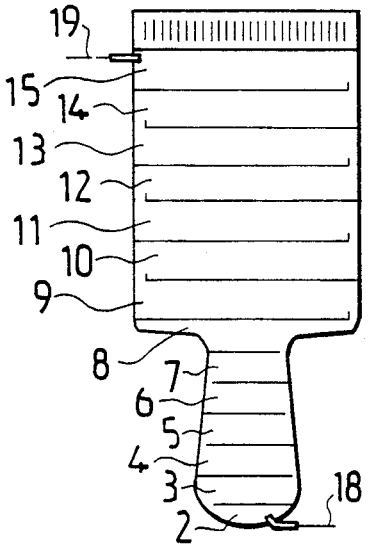
FIG. 2 presents the jacket bag components, in open position.

The device consists of consecutive annular, mutually connected elastic jacket bags 2–15 around the leg 1, in which pressures may be produced by the aid of a pressure source P and a fluid, such as air, these pressures producing a massaging effect. The intervening space 16 defined between the jacket bags 2–15 and the leg 1 has also been connected to the pressure source P and can consequently be pressurized, in which case the jacket bags 2–15 may by, the aid of the pressure in the intervening space, be simultaneously depleted of pressure and further, after the jacket bags have been pressurized, the intervening space 16 may, by the aid of the pressure in the jacket bags, be depleted of pressure. The pressures in the jacket bags 2–15 and in the intervening space 16 are controlled by a multiple-way valve 17, by which the pressure can be conducted alternating into the jacket bags 2–15 and into the intervening space 16.

The operation of the device is as follows. The pressure provided by pump P, which may be on the order of 120 mmHg, enters by the tube 18 the jacket bags 2, 3, 4 . . . 15, whereby they are filled in succession and cause an upward massaging motion. When the last jacket bag 15 has been filled, the pressure may discharge through the tube 19, causing a pulse acting on the multiple-way valve 17 and which switches the pressure from pump P over to the tube 20 connected to the intervening space 16. The intervening space 16 is now filled with pressure starting upwards from the toes, the jacket bags 2–15 simultaneously being depleted through the tube 19. Thus, another upward acting massaging force in the same direction is produced. After the pressure in the intervening space 16 has filled the intervening space to the top, the pressure may discharge through the tube 21, causing at the same time a pulse acting on the multiple-way valve 17 which again assumes the other position, whereby the cycles just described are repeated. It is thus understood that, with the aid of the device, two massaging pressure waves in the same direction are obtained, and the air mass moving in the intervening space 16 against the skin serves as ventilation air, which may be cooled or heated as needed by temperature controller (heater or cooler) TC.

On long-distance flights, lasting for instance more than six hours' duration, the passengers' feet tend to swell, with the consequence that their shoes no longer fit and that the feet are tired, aching and frequently feel restless. Disturbance of venous circulation ensues from the lack of muscular pump action, and also from the mechanical stenosis of veins caused by sitting. The device is an excellant in these problems.

FIG. 3 shows a pad 30, underneath the foot of a person wearing the device of the present invention. Pump 30 is operated by pressure when the person pushes down with his foot, for example, while walking.

It is obvious to a person skilled in the art that the invention is not confined to the example presented in the foregoing and that it, may vary within the scope of the claims stated below. For instance, the device is obviously also usable on an upper extremity.

We claim:

1. A device for massaging a bodily extremity, said device comprising:

a plurality of mutually and annularly connected jacket bags in mutual fluid communication through borders therebetween, said plurality of mutually connected jacket bags defining a first chamber;

a means for providing pressurized fluid;

a first inflow passage for supplying fluid from said means for supplying pressurized fluid to said first chamber:

a first outflow passage for removing fluid from said first chamber;

a means for sealing said plurality of jacket bags about the extremity so as to define an airtight second chamber, bounded on one side by the extremity, between said plurality of jacket bags and the extremity, said second chamber permitting fluid contact of fluid within said second chamber with the extremity, thereby ventilating the extremity;

a second inflow passage for supplying fluid from said means for supplying pressurized fluid to said second chamber;

a second outflow passage for removing fluid from said second chamber;

a valve, connected to said first and second inflow passages, including means for opening said first inflow passage, means for closing said first inflow passage and opening said second inflow passage when said jacket bags have filled with the fluid, and means for thereafter closing said second inflow passage when said second chamber is filled with the fluid;

whereby, when fluid pressure is applied to said first inflow passage, said jacket bags fill in succession along said first chamber, from said first inflow passage to said first outflow passage, and when fluid is supplied to said second chamber, the extremity is ventilated while said jacket bags are depleted of fluid.

2. The device of claim 1, wherein said valve is a multiple-way valve, connected to said first and second inflow and outflow passages, for responding to a predetermined fluid pressure in said first outflow passage, by closing said first inflow passage and opening said second inflow passage, and to a predetermined fluid pressure in said second outflow passage, by closing said second inflow passage and opening said first inflow passage.

3. The device of claim 1, wherein said means of said valve for closing said second inflow passage also causes opening of said first inflow passage when said second chamber is filled with the fluid.

4. The device of claim 1, wherein said pressurized fluid supplying means comprises a pump.

5. The device of claim 4, wherein said extremity comprises a foot and said pump comprises a pad under said foot, operable by pressure exerted upon said pad by said foot.

6. The device of claim 1, wherein said fluid comprises air.

7. The device of claim 6, further comprises means for controlling the temperature of said air.

8. The device of claim 1 wherein said fluid is oxygen.

9. The device of claim 8, further comprising means for controlling the temperature of said oxygen.

* * * * *